US008485624B2

(12) United States Patent
Mikami et al.

(10) Patent No.: US 8,485,624 B2
(45) Date of Patent: Jul. 16, 2013

(54) DROPLET DISPENSING CONTROL METHOD, DROPLET DISPENSING CONTROL DEVICE, AND METHOD OF MANUFACTURING SEMICONDUCTOR DEVICES

(75) Inventors: Shinji Mikami, Kanagawa (JP); Ikuo Yoneda, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 179 days.

(21) Appl. No.: 13/235,054

(22) Filed: Sep. 16, 2011

(65) Prior Publication Data

US 2012/0075368 A1 Mar. 29, 2012

(30) Foreign Application Priority Data

Sep. 24, 2010 (JP) ..... 2010-213615

(51) Int. Cl.
*B41J 29/38* (2006.01)

(52) U.S. Cl.
USPC ..... 347/9; 347/2; 347/14; 347/19

(58) Field of Classification Search
USPC ..... 347/2, 5, 9, 14, 19
See application file for complete search history.

(56) References Cited

U.S. PATENT DOCUMENTS

| | | | | |
|---|---|---|---|---|
| 6,921,615 | B2 | 7/2005 | Sreenivasan et al. | |
| 7,360,851 | B1 * | 4/2008 | Snyder | 347/2 |
| 2009/0267268 | A1 | 10/2009 | Yoneda et al. | |
| 2011/0066273 | A1 | 3/2011 | Yoneda et al. | |

FOREIGN PATENT DOCUMENTS

| | | |
|---|---|---|
| JP | 2000-194142 | 7/2000 |
| JP | 2001-68411 | 3/2001 |
| JP | 2007-299994 | 11/2007 |
| JP | 2009-281945 | 12/2009 |
| JP | 2010-80630 | 4/2010 |

* cited by examiner

*Primary Examiner* — Juanita D Jackson
(74) *Attorney, Agent, or Firm* — Finnegan, Henderson, Farabow, Garrett & Dunner, L.L.P.

(57) ABSTRACT

According to one embodiment, a droplet dispensing control method includes detecting an amount of positional deviation between a stage on which a substrate is mounted and a template as a template positional deviation amount and detecting an amount of positional deviation between a movement direction of the stage and a nozzle array direction as a nozzle positional deviation amount. The method further includes calculating a stage movement direction correction value and an ejection timing correction value of the imprint material as correction values for eliminating the positional deviation of the landing position of the imprint material. The method further includes controlling the movement direction of the stage using the stage movement direction correction value and controlling the ejection timing of the imprint material using the ejection timing correction value.

20 Claims, 6 Drawing Sheets

DROPLET DISPENSING CONTROL METHOD, DROPLET DISPENSING CONTROL DEVICE, AND METHOD OF MANUFACTURING SEMICONDUCTOR DEVICES

CROSS-REFERENCE TO RELATED APPLICATIONS

This application is based upon and claims the benefit of priority from the prior Japanese Patent Application No. 2010-213615, filed on Sep. 24, 2010; the entire contents of which are incorporated herein by reference.

FIELD

Embodiments described herein relate generally to a droplet dispensing control method, a droplet dispensing control device, and a method of manufacturing semiconductor devices.

BACKGROUND

In the process of manufacturing semiconductor devices, a photo nanoimprint method which transfers the mold (template) of a master stamp to a transfer substrate (hereinafter referred to as a substrate) is being paid attention as a technique capable of enabling both of formation of micro-patterns of 100 nm or less and mass-production. In the photo nanoimprint method, the mold of a master stamp on which patterns to be transferred are formed is pressed into a photo-curable organic material layer (imprint material) applied onto a substrate. In this state, the imprint material is irradiated with light and cured. In this way, the patterns are transferred to the imprint material.

The imprint material is dispensed by an ink jet method and applied onto the substrate for each shot area. In the photo nanoimprint method, a positional deviation wherein the position of a stage with the substrate mounted thereon deviates from the position at which the template is pressed is likely to occur. Moreover, the position of a nozzle array of an ink jet head is likely to tilt at an angle to the movement direction of the stage. Thus, this also may cause another positional deviation wherein the position (landing position) at which the droplet of the imprint material lands on the substrate deviates from an intended landing position. If the landing position of the imprint material is not appropriate for the shot area, defects or faults in filling of the imprint material and fluctuation in thickness are more likely to occur at the periphery of the shot area where the amount of deviation in the landing position is great. As a result, defects would occur in the formed patterns after processing, which can impair the yield of devices. Therefore, it is desirable to dispense the imprint material so as to land at a proper position.

DETAILED DESCRIPTION

In general, according to one embodiment, a droplet dispensing control method includes detecting an amount of positional deviation in a rotation direction in a stage plane between a stage mounting a substrate on which an imprint material from an ink jet head lands and a template that is pressed into the imprint material on the substrate, as a template positional deviation amount. The method further includes detecting an amount of positional deviation in a rotation direction in the stage plane between a movement direction of the stage and a nozzle array direction of a plurality of nozzles provided in the ink jet head, as a nozzle positional deviation amount. The method further includes calculating a stage movement direction correction value for correcting the movement direction of the stage and an ejection timing correction value for correcting the ejection timing of the imprint material ejected from the respective nozzles, as a correction value for eliminating the positional deviation of a landing position of the imprint material occurring due to the template positional deviation amount and the nozzle positional deviation amount. The method further includes controlling the movement direction of the stage using the stage movement direction correction value and controlling the ejection timing of the imprint material ejected from the respective nozzles using the ejection timing correction value.

Exemplary embodiments of a droplet dispensing control method, a droplet dispensing control device, and a method of manufacturing semiconductor devices will be explained below in detail with reference to the accompanying drawings. The present invention is not limited to the following embodiments.

Embodiments

Figure 1:
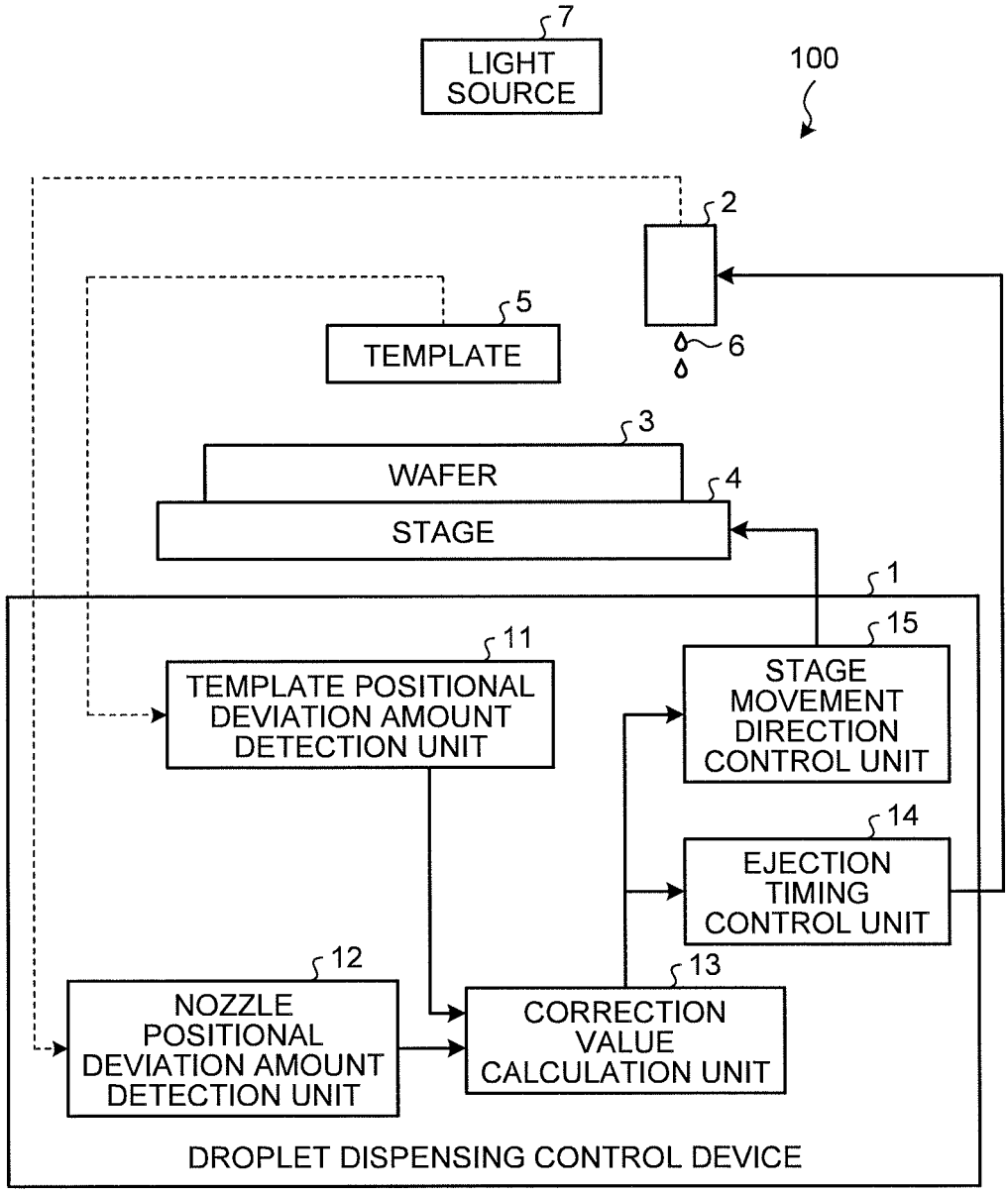
FIG. 1 is a diagram illustrating the configuration of an imprint device having a droplet dispensing control device according to an embodiment.

FIG. 1 is a view illustrating the configuration of an imprint device having a droplet dispensing control device according to an embodiment. An imprint device 100 is a device that is used in an imprint method (for example, photo nanoimprint lithography) which is one of the processes of manufacturing semiconductor devices. The imprint device 100 is configured to include a droplet dispensing control device 1, an ink jet head 2, a stage (substrate mounting stage) 4, and a light source 7.

The imprint device 100 dispenses droplets of a resist (imprint material) 6 onto a transfer substrate such as a wafer 3 and presses a template 5 onto the wafer 3 to thereby transfer the template pattern to the wafer 3. The imprint device 100 of the present embodiment controls the movement direction of the stage 4 and the ejection timing of the resist 6 so as to correct the amount of positional deviation of the template 5 with respect to the stage 4 and the amount of positional deviation of a nozzle array with respect to the movement direction of the stage 4.

The ink jet head 2 has a plurality of nozzles. The respective nozzles are arranged as a nozzle array at predetermined intervals in a predetermined direction. The ink jet head 2 ejects droplets of the resist 6 through the respective nozzles so as to land (be applied) on the wafer 3. The stage 4 holds the wafer 3 mounted thereon and moves it in the in-plane (XY plane)

direction of the wafer 3. The resist 6 is a photo-curable organic material, for example.

The template 5 is a mold of a master stamp and the patterns (semiconductor circuit patterns) to be transferred onto the wafer 3 are formed thereon. The template 5 is pressed onto the wafer 3 on which the resist 6 is dispensed. The light source 7 irradiates the resist 6 filled between the template 5 and the wafer 3 with light such as UV light.

The droplet dispensing control device 1 includes a template positional deviation amount detection unit 11, a nozzle positional deviation amount detection unit 12, a correction value calculation unit 13, an ejection timing control unit 14, and a stage movement direction control unit 15.

The template positional deviation amount detection unit 11 detects the amount of positional deviation (amount of rotational deviation) in the rotation direction in the stage plane between the stage 4 and the template 5 (the wafer 3) as a template positional deviation amount. In other words, the template positional deviation amount detection unit 11 detects the mounting position of the template 5 on the stage 4. Specifically, the template positional deviation amount detection unit 11 detects a template positional deviation amount when the template 5 is contacted (pressed) onto the resist 6 on the wafer 3. The template positional deviation amount detection unit 11 detects the template positional deviation amount by detecting the position of the stage 4 and the mounting position of the template 5, for example. The template positional deviation amount detection unit 11 transmits the detected template positional deviation amount to the correction value calculation unit 13.

The nozzle positional deviation amount detection unit 12 detects the amount of positional deviation of a nozzle array with respect to the movement direction of the stage 4 as a nozzle positional deviation amount. Specifically, the nozzle positional deviation amount detection unit 12 detects a nozzle positional deviation amount between the movement direction (XY-directional movement axis) of the stage 4 and an arrangement direction of the nozzle array as an in-plane deviation amount (rotational deviation amount). For example, when the stage 4 moves in the X-axis direction, and the nozzle array is arranged in the Y-axis direction, the amount of angular deviation (the amount of deviation from 90 degrees) between the movement direction of the stage 4 and the arrangement direction of the nozzle array becomes the nozzle positional deviation amount. The nozzle positional deviation amount detection unit 12 detects the nozzle positional deviation amount by detecting the movement direction of the stage 4 and the arrangement direction of the nozzle array, for example. The nozzle positional deviation amount detection unit 12 transmits the detected nozzle positional deviation amount to the correction value calculation unit 13.

The correction value calculation unit 13 calculates a correction value (stage movement direction correction value) for correcting the movement direction of the stage 4 and a correction value (ejection timing correction value) for correcting the ejection timing of the resist 6 based on the template positional deviation amount and the nozzle positional deviation amount. The correction value calculation unit 13 calculates the stage movement direction correction value and the ejection timing correction value for dispensing droplets of the resist 6 to land at a desired position on the wafer 3. In other words, the correction value calculation unit 13 calculates the stage movement direction correction value and the ejection timing correction value for eliminating the positional deviation of the resist landing position which occurs due to the template positional deviation amount and the nozzle positional deviation amount. The correction value calculation unit 13 transmits the calculated stage movement direction correction value to the stage movement direction control unit 15 and the calculated ejection timing correction value to the ejection timing control unit 14.

The ejection timing control unit 14 controls the ejection timing of the resist 6 ejected from the nozzles. The ejection timing control unit 14 corrects the ejection timing of the resist 6 ejected from the nozzles using the ejection timing correction value. The stage movement direction control unit 15 controls the movement direction of the stage 4. The stage movement direction control unit 15 corrects the movement direction of the stage 4 using the stage movement direction correction value.

Figure 2:
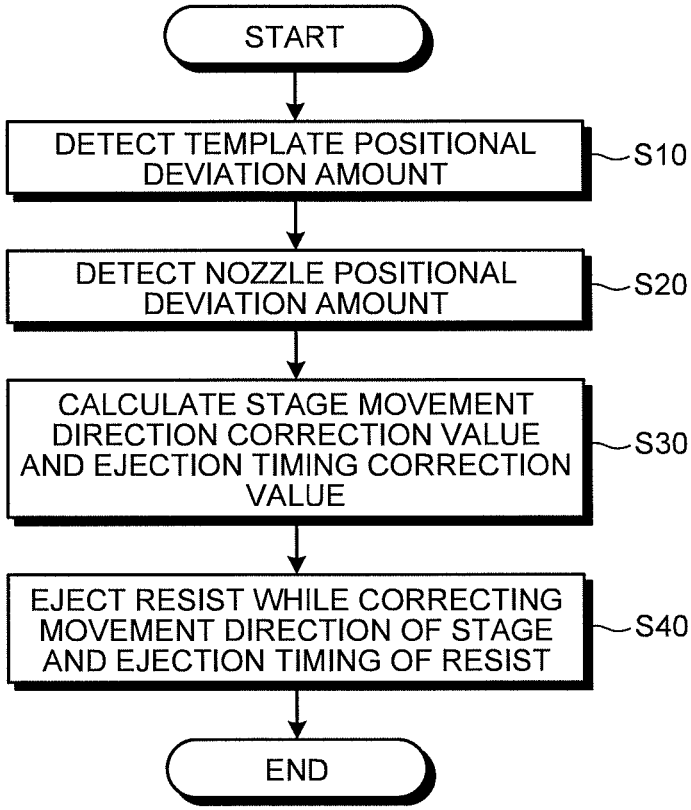
FIG. 2 is a flowchart illustrating the flow of a resist ejection process.

Next, the flow of a process of ejecting the resist 6 will be described. FIG. 2 is a flowchart illustrating the flow of a resist ejecting process. The template positional deviation amount detection unit 11 detects the amount of positional deviation of the template 5 with respect to the stage 4 as a template positional deviation amount (step S10).

In the present embodiment, for example, a plurality of marks for detecting position is formed on the template 5. Moreover, the template 5 is loaded onto a test wafer in advance. After that, the template positional deviation amount detection unit 11 detects the template positional deviation amount by measuring the positions of the position detection marks. The template positional deviation amount detection unit 11 may detect the template positional deviation amount by detection part of template patterns formed on the template 5. The template positional deviation amount detection unit 11 transmits the detected template positional deviation amount to the correction value calculation unit 13.

The nozzle positional deviation amount detection unit 12 detects the amount of positional deviation of the nozzle array with respect to the movement direction of the stage 4 as the nozzle positional deviation amount (step S20). In other words, the nozzle positional deviation amount detection unit 12 detects a wafer scanning direction and a nozzle array tilt during ink-jetting (resist-ejecting). The nozzle positional deviation amount is a relative positional deviation amount between the movement direction of the stage 4 and the arrangement direction of the nozzle array. The template positional deviation amount may be detected after detecting the nozzle positional deviation amount. Moreover, the nozzle positional deviation amount and the template positional deviation amount may be detected at the same time.

In the present embodiment, droplets of the resist 6 are dispensed from the nozzles so as to land on a test wafer, for example, without correcting the movement direction of the stage 4 and the ejection timing. Moreover, in a state where the test wafer is mounted on the stage 4, the nozzle positional deviation amount detection unit 12 detects the nozzle positional deviation amount by measuring the landing position of the resist 6.

Figure 3A:
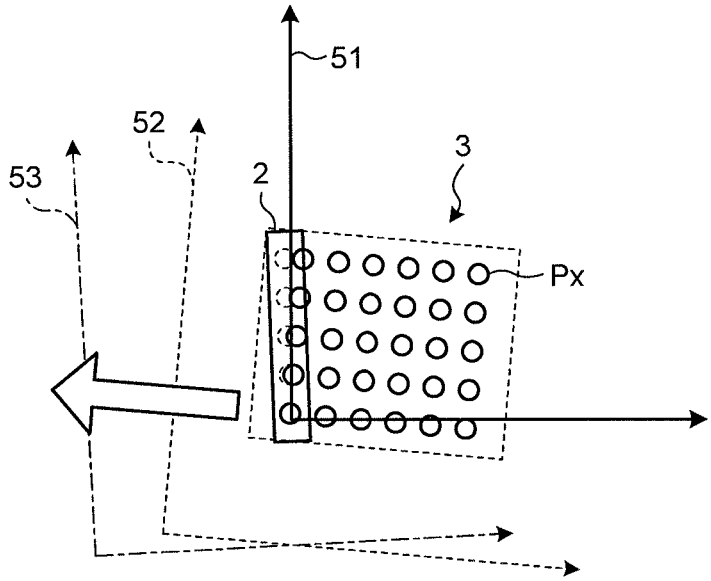
FIGS. 3A and 3B are diagrams illustrating a template positional deviation amount and a nozzle positional deviation amount.
Figure 3B:
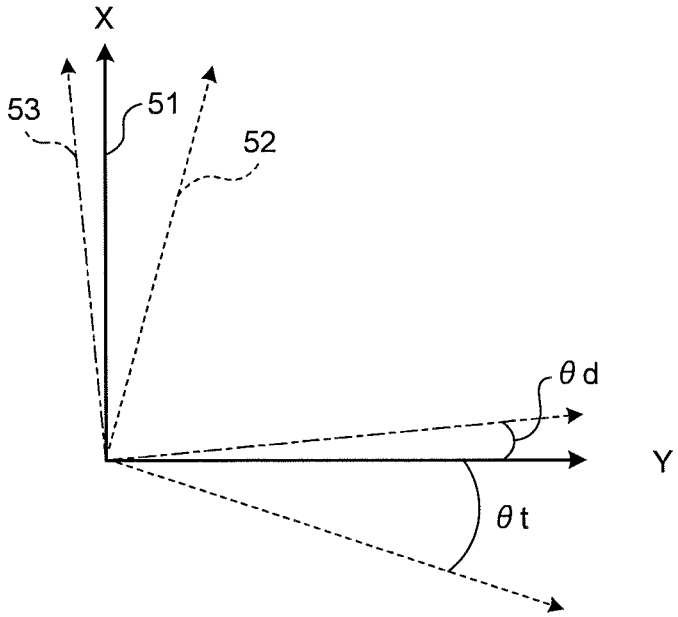

Here, the template positional deviation amount and the nozzle positional deviation amount will be described. FIGS. 3A and 3B are views illustrating the template positional deviation amount and the nozzle positional deviation amount. FIG. 3A illustrates a top view of the wafer 3 when dispensing of droplets of the resist 6 starts.

The axes 51 to 53 illustrated in FIG. 3A are the XY axes. The axes 51 are the XY axes corresponding to the original movement direction (with no deviation) of the stage 4. Thus, when both the template positional deviation amount and the nozzle positional deviation amount are zero, the wafer 3 mounted on the stage 4 moves in a direction parallel to one (horizontal axis) of the axes 51.

The axes 52 are the XY axes based on the arrangement position (the pressing position of the template 5) of the wafer 3, and are positionally deviated from the axes 51 by a predetermined rotational amount. This rotational amount corresponds to the template positional deviation amount. A desired resist landing position Px is set to the wafer 3. Since there is a positional deviation between the axes 52 and the axes 51, the resist landing position Px is positionally deviated from the axes 51 by the predetermined rotational amount.

The axes 53 are the XY axes based on the movement direction of the stage 4 with respect to the nozzle array, and are positionally deviated from the axes 51 by a predetermined rotational amount. This rotational amount corresponds to the nozzle positional deviation amount.

In FIG. 3B, the template positional deviation amount is depicted by a rotational deviation amount θt between the axes 51 and the axes 52, and the nozzle positional deviation amount is depicted by a rotational deviation amount θd between the axes 51 and the axes 53. In the present embodiment, the movement direction of the stage 4 and the ejection timing of the resist 6 are corrected so as to eliminate the rotational deviation amounts θt and θd.

After the template positional deviation amount and the nozzle positional deviation amount are detected using the test wafer 3 or the like, the test wafer 3 is unloaded from the stage 4. Moreover, a wafer 3 (product wafer or the like) on which actual template patterns are formed is loaded on the stage 4.

The correction value calculation unit 13 calculates a stage movement direction correction value for correcting the movement direction of the stage 4 and an ejection timing correction value for correcting the ejection timing of the resist 6 based on the template positional deviation amount and the nozzle positional deviation amount (step S30). In the ink jet head 2, a plurality of nozzles is arranged in the Y-axis direction at predetermined intervals (nozzle pitches) D. Thus, the correction value calculation unit 13 calculates the ejection timing correction value for each nozzle. The process of calculating the stage movement direction correction value and the ejection timing correction value may be performed before the wafer 3 on which actual template patterns is loaded on the stage 4.

For example, the correction value calculation unit 13 calculates stage movement direction correction values Xc and Yc expressed by Expressions (1) and (2) and an ejection timing correction value X(Dn) illustrated in Expression (3).

$$Xc=X\times\theta t\times\cos((1-\theta t)/2) \quad (1)$$

$$Yc=X\times\sin((1-\theta t)/2) \quad (2)$$

$$X(Dn)=n(\theta t+\theta d\times D) \quad (3)$$

Here, X is the movement direction of the stage 4 before correction, and D is the distance between nozzles. Moreover, n is an index of the nozzle and is a natural number. A reference nozzle (a nozzle which is the first one arriving at the resist ejecting position) has an index n=1, and a nozzle which is the M-th one (M is a natural number) arriving at the resist ejecting position has an index n=M. Thus, Dn is the distance (y-coordinate) of the nozzle from the point of origin of the nozzle.

The correction value calculation unit 13 transmits the calculated stage movement direction correction value to the stage movement direction control unit 15 and the calculated ejection timing correction value to the ejection timing control unit 14. The stage movement direction control unit 15 controls the movement direction of the stage 4 while correcting the movement direction of the stage 4 using the stage movement direction correction value. In this case, the ejection timing control unit 14 controls the ejection timing of the resist 6 while controlling the ejection timing using the ejection timing correction value. In other words, the droplets of the resist 6 are ejected while the movement direction of the stage 4 and the ejection timing of the resist 6 are corrected (step S40).

The stage movement direction control unit 15 controls the stage 4 so that the stage 4 is moved in the directions X' and Y' expressed by Expressions (4) and (5). Moreover, the ejection timing control unit 14 corrects the ejection timing of the resist 6 based on Expression (3).

$$X'=X-Xc\times X-(X\times\theta t\times\cos((1-\theta t)/2)) \quad (4)$$

$$Y'=Yc=X\times\sin((1-\theta t)/2) \quad (5)$$

Figure 4A:
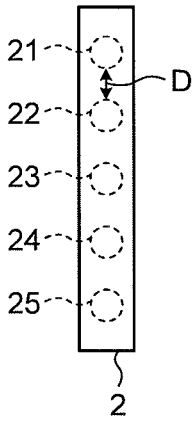
FIGS. 4A and 4B are diagrams illustrating a positional deviation of a resist ejecting position.
Figure 4B:
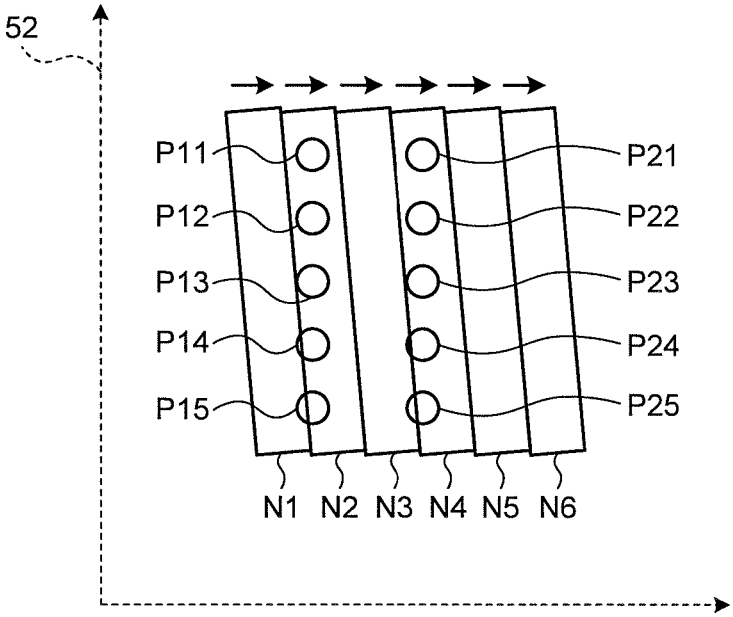

Next, the ejection timing of the resist 6 will be described. FIGS. 4A and 4B are views illustrating the positional deviation of the resist ejecting position, and FIG. 5 is a view illustrating the resist ejection timing.

As illustrated in FIG. 4A, five nozzles 21 to 25 are arranged on the ink jet head 2 at intervals of D. In FIG. 4B, desired resist landing positions Px set on the wafer 3 are depicted by resist landing positions P11 to P15 and P21 to P25. Moreover, the relative positions of the ink jet head 2 to the stage 4 are depicted by positions N1 to N6.

As illustrated in FIG. 4B, the relative position of the ink jet head 2 moves up to the positions N1 to N6 as the stage 4 moves. In this case, the stage 4 is moved based on the stage movement direction correction value so that the nozzles 21 to 25 passes over the resist landing positions P11 to P15 and then over the resist landing positions P21 to P25.

Figure 5:
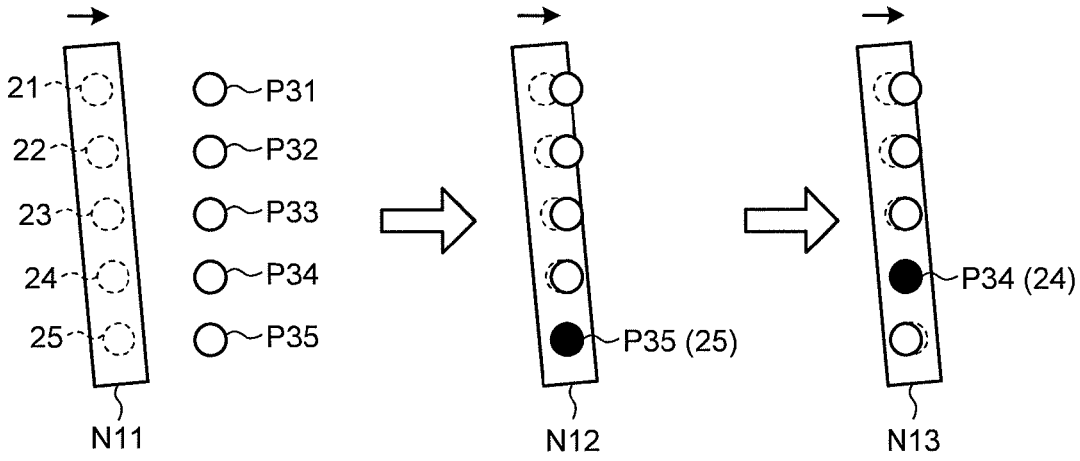
FIG. 5 is a diagram illustrating resist ejection timing.

In FIG. 5, the desired resist landing positions Px are depicted by resist landing positions P31 to P35. Moreover, the relative positions of the ink jet head 2 to the stage 4 are depicted by positions N11 to N13.

The stage 4 is moved so that the nozzles 21 to 25 pass over the resist landing positions P31 to P35, respectively. At the position N11, ejection of the resist 6 is not performed since the nozzles 21 to 25 have not arrived at the resist landing positions P31 to P35.

When the relative position of the ink jet head 2 to the stage 4 reaches the position N12, the nozzle 25 arrives at the resist landing position P35, and at this point of time, the droplets of the resist 6 are ejected from the nozzle 25.

When the relative position of the ink jet head 2 to the stage 4 reaches the position N13, the nozzle 24 arrives at the resist landing position P34, and at this point of time, the droplets of the resist 6 are ejected from the nozzle 24.

Subsequently, similarly, the droplets of the resist 6 are ejected from the nozzle 23 at the point in time when the nozzle 23 arrives at the resist landing position P33. Moreover, the droplets of the resist 6 are ejected from the nozzle 22 at the point in time when the nozzle 22 arrives at the resist landing position P32. Furthermore, the droplets of the resist 6 are ejected from the nozzle 21 at the point in time when the nozzle 21 arrives at the resist landing position P31.

Figure 6:
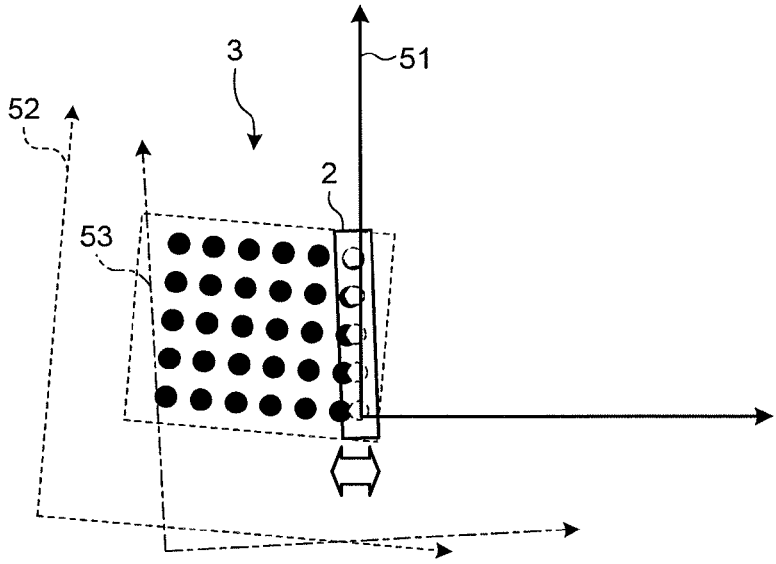
FIG. 6 is a top view of a wafer in a state in which an ejection operation of a resist ended.

FIG. 6 illustrates a top view of a wafer when ejection of a resist ends. As illustrated in the figure, in the present embodiment, the stage 4 is moved and the ejection timing of the resist 6 is corrected based on the stage movement direction correction value and the discharge timing correction value. Thus, it is possible to dispense droplets of the resist 6 so as to land at a desired position on the wafer 3.

When imprinting is performed, the imprint device 100 dispenses the droplets of the resist 6 so as to land at a desired position (an effective area corresponding to one shot area of the template 5) on the wafer 3. Then, the template 5 on which patterns to be transferred are formed is pressed into the resist 6 on the wafer 3. In this way, the resist 6 is filled between the template 5 and the wafer 3. In this state, the resist 6 is irradiated with light emitted from the light source 7, and the resist 6 is cured. After that, the template 5 is removed from the resist 6 (demolding process). In this way, the pattern (shape) of the template 5 is transferred to the resist 6 on the wafer 3.

Subsequently, the lower layer side of the wafer 3 is etched using the pattern transferred resist 6 as a mask. In this way, the real pattern corresponding to the pattern of the template 5 is formed on the wafer 3. When a semiconductor device (a semiconductor integrated circuit) is manufactured, the above-mentioned processes of dispensing the resist 6, curing the resist 6, demolding the template 5, and etching the wafer 3 are repeatedly performed for each layer.

Figure 7:
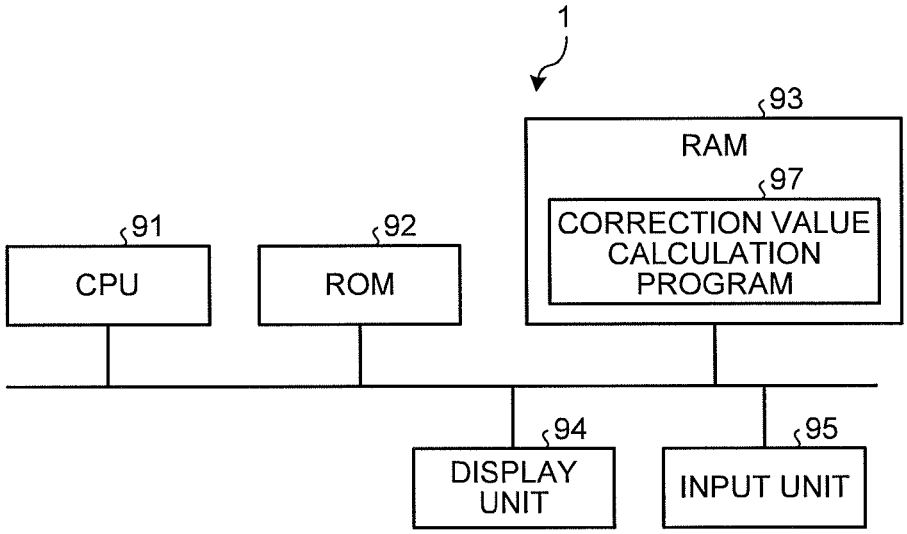
FIG. 7 is a diagram illustrating the hardware configuration of a droplet dispensing control device.

Next, the hardware configuration of the droplet dispensing control device 1 will be described. FIG. 7 is a view illustrating the hardware configuration of the droplet dispensing control device. The droplet dispensing control device 1 includes a central processing unit (CPU) 91, a read only memory (ROM) 92, a random access memory (RAM) 93, a display unit 94, and an input unit 95. In the droplet dispensing control device 1, the CPU 91, the ROM 92, the RAM 93, the display unit 94, and the input unit 95 are connected through a bus line.

The CPU 91 calculates a stage movement direction correction value and an ejection timing correction value using a correction value calculation program 97 which is a computer program. The display unit 94 is a display device such as a liquid crystal monitor and displays a template positional deviation amount, a nozzle positional deviation amount, a stage movement direction correction value, an ejection timing correction value, and the like based on an instruction from the CPU 91. The input unit 95 is configured to include a mouse or a keyboard and receives instruction information (parameters required for calculating the stage movement direction correction value and the ejection timing correction value) input from the user. The instruction information input to the input unit 95 is sent to the CPU 91.

The correction value calculation program 97 is stored in the ROM 92 and is load into the RAM 93 through the bus line. FIG. 7 illustrates a state in which the correction value calculation program 97 is loaded into the RAM 93.

The CPU 91 executes the correction value calculation program 97 loaded into the RAM 93. Specifically, in the droplet dispensing control device 1, the CPU 91 reads the correction value calculation program 97 from the ROM 92, expands the correction value calculation program 97 in a program storage area within the RAM 93, and executes various processes in response to the instruction from the input unit 95 input by the user. The CPU 91 temporarily stores various data generated during the various processes in the data storage area formed in the RAM 93.

The correction value calculation program 97 executed by the droplet dispensing control device 1 has a modular configuration including the template positional deviation amount detection unit 11, the nozzle positional deviation amount detection unit 12, the correction value calculation unit 13, the ejection timing control unit 14, and the stage movement direction control unit 15, and these units are loaded onto a main storage device and generated on the main storage device.

In the present embodiment, although the droplet dispensing control device 1 is configured to include the template positional deviation amount detection unit 11 and the nozzle positional deviation amount detection unit 12, the template positional deviation amount detection unit 11 may be separated from the droplet dispensing control device 1. Moreover, the nozzle positional deviation amount detection unit 12 may be separated from the droplet dispensing control device 1. Furthermore, the ejection timing control unit 14 may be separated from the droplet dispensing control device 1. Furthermore, the stage movement direction control unit 15 may be separated from the droplet dispensing control device 1.

As above, according to the embodiment, the movement direction of the stage 4 and the ejection timing of the resist 6 are controlled so as to eliminate the positional deviation of the landing position of the imprint material occurring due to the template positional deviation amount and the nozzle positional deviation amount. Thus, it is possible to dispense droplets of the resist 6 so as to land at an appropriate position (intended landing position) on the wafer 3. In this way, it is possible to prevent defects or faults in filling of the resist 6 and fluctuation in thickness. As a result, it is possible to prevent pattern formation defects and to improve the yield ratio of devices.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A droplet dispensing control method comprising:

detecting an amount of positional deviation in a rotation direction in a stage plane between a stage mounting a substrate on which an imprint material from an ink jet head lands and a template that is pressed into the imprint material on the substrate, as a template positional deviation amount;

detecting an amount of positional deviation in a rotation direction in the stage plane between a movement direction of the stage and a nozzle array direction of a plurality of nozzles provided on the ink jet head, as a nozzle positional deviation amount;

calculating a stage movement direction correction value configured to correct the movement direction of the stage and an ejection timing correction value configured to correct the ejection timing of the imprint material ejected from the respective nozzles, as a correction value for eliminating the positional deviation of a landing position of the imprint material occurring due to the template positional deviation amount and the nozzle positional deviation amount; and controlling the movement direction of the stage using the stage movement direction correction value and controlling the ejection timing of the imprint material ejected from the respective nozzles using the ejection timing correction value.

2. The droplet dispensing control method according to claim 1, wherein position detection marks are formed in advance on the template, and wherein the template positional deviation amount is detected by measuring the positions of the position detection marks when the template is loaded on the stage.

3. The droplet dispensing control method according to claim 1, wherein the template positional deviation amount is detected by measuring the position of a template pattern on the template when the template is loaded on the stage.

4. The droplet dispensing control method according to claim 1, wherein the template positional deviation amount is detected in a state where the template is pressed into the imprint material on the substrate.

5. The droplet dispensing control method according to claim 1, wherein the nozzle positional deviation amount is detected by measuring the landing position when the imprint material is dispensed onto the substrate from the ink jet head without correcting the movement direction of the stage and the ejection timing of the imprint material.

6. The droplet dispensing control method according to claim 1, wherein, when the template positional deviation amount is $\theta t$, the nozzle positional deviation amount is $\theta d$, and the movement direction of the stage before correcting the movement direction of the stage is an X-direction, the movement directions X' and Y' of the stage after correcting the movement direction of the stage are expressed by $X'=X-(X\times\theta t\times\cos((1-\theta t)/2))$ and $Y'=X\times\sin((1-\theta t)/2)$, respectively.

7. The droplet dispensing control method according to claim 1, wherein, when the template positional deviation amount is $\theta t$, the nozzle positional deviation amount is $\theta d$, the nozzle pitch of the nozzle array is D, and the movement direction of the stage before correcting the movement direction of the stage is an X-direction, an ejection timing correction value X(Dn) of the imprint material for a nozzle that is disposed on the n-th order from a reference nozzle position is expressed by $X(Dn)=n(\theta t+\theta d)$.

8. A droplet dispensing control device comprising:

a first detection unit that detects an amount of positional deviation of a rotation direction in a stage plane between a stage mounting a substrate on which an imprint material from an ink jet head lands and a template that is pressed into the imprint material on the substrate, as a template positional deviation amount;

a second detection unit that detects an amount of positional deviation of a rotation direction in the stage plane between a movement direction of the stage and a nozzle array direction of a plurality of nozzles provided on the ink jet head, as a nozzle positional deviation amount;

a correction value calculation unit that calculates a stage movement direction correction value configured to correct the movement direction of the stage and an ejection timing correction value configured to correct the ejection timing of the imprint material ejected from the respective nozzles, as a correction value for eliminating the positional deviation of a landing position of the imprint material occurring due to the template positional deviation amount and the nozzle positional deviation amount; and a first control unit that controls the movement direction of the stage using the stage movement direction correction value; and a second control unit that controls the ejection timing of the imprint material ejected from the respective nozzles using the ejection timing correction value.

9. The droplet dispensing control device according to claim 8, wherein position detection marks are formed in advance on the template, and wherein the first detection unit detects the template positional deviation amount by measuring the positions of the position detection marks when the template is loaded on the stage.

10. The droplet dispensing control device according to claim 8, wherein the first detection unit detects the template positional deviation amount by measuring the position of a template pattern on the template when the template is loaded on the stage.

11. The droplet dispensing control device according to claim 8, wherein the first detection unit detects the template positional deviation amount in a state where the template is pressed into the imprint material on the substrate.

12. The droplet dispensing control device according to claim 8, wherein the second detection unit detects the nozzle positional deviation amount by measuring the landing position when the imprint material is dispensed onto the substrate from the ink jet head without correcting the movement direction of the stage and the ejection timing of the imprint material.

13. The droplet dispensing control device according to claim 8, wherein, when the template positional deviation amount is $\theta t$, the nozzle positional deviation amount is $\theta d$, and the movement direction of the stage before correcting the movement direction of the stage is an X-direction, the correction value calculation unit calculates the movement directions X' and Y' of the stage after correcting the movement direction of the stage by an expression of $X'=X-(X\times\theta t\times\cos((1-\theta t)/2))$ and $Y'=X\times\sin((1-\theta t)/2)$, respectively.

14. The droplet dispensing control device according to claim 8, wherein, when the template positional deviation amount is $\theta t$, the nozzle positional deviation amount is $\theta d$, the nozzle pitch of the nozzle array is D, and the movement direction of the stage before correcting the movement direction of the stage is an X-direction, the correction value calculation unit calculates an ejection timing correction value X(Dn) of the imprint material for a nozzle that is disposed on the n-th order from a reference nozzle position by an expression of $X(Dn)=n(\theta t+\theta d)$.

15. A method of manufacturing semiconductor devices comprising:

detecting an amount of positional deviation of a rotation direction in a stage plane between a stage mounting a substrate on which an imprint material from an ink jet head lands and a template that is pressed into the imprint material on the substrate, as a template positional deviation amount;

detecting an amount of positional deviation of a rotation direction in the stage plane between a movement direction of the stage and a nozzle array direction of a plurality of nozzles provided on the ink jet head, as a nozzle positional deviation amount;

calculating a stage movement direction correction value configured to correct the movement direction of the stage and an ejection timing correction value configured to correct the ejection timing of the imprint material ejected from the respective nozzles as a correction value for eliminating the positional deviation of a landing position of the imprint material occurring due to the template positional deviation amount and the nozzle positional deviation amount;

dispensing the imprint material onto the substrate while controlling the movement direction of the stage using the stage movement direction correction value and controlling the ejection timing of the imprint material ejected from the respective nozzles using the ejection timing correction value;

pressing the template into the imprint material on the substrate to thereby transfer the pattern of the template to the imprint material.

16. The method of manufacturing semiconductor devices according to claim 15, wherein position detection marks are formed in advance on the template, and wherein the template positional deviation amount is detected by measuring the positions of the position detection marks when the template is loaded on the stage.

17. The method of manufacturing semiconductor devices according to claim 15, wherein the template positional deviation amount is detected by measuring the position of a template pattern on the template when the template is loaded on the stage.

18. The method of manufacturing semiconductor devices according to claim 15, wherein the template positional deviation amount is detected in a state where the template is pressed into the imprint material on the substrate.

19. The method of manufacturing semiconductor devices according to claim 15, wherein the nozzle positional deviation amount is detected by measuring the landing position when the imprint material is dispensed onto the substrate from the ink jet head without correcting the movement direction of the stage and the ejection timing of the imprint material.

20. The method of manufacturing semiconductor devices according to claim 15, wherein, when the template positional deviation amount is $\theta t$, the nozzle positional deviation amount is $\theta d$, the nozzle pitch of the nozzle array is D, and the movement direction of the stage before correcting the movement direction of the stage is an X-direction, the movement directions X' and Y' of the stage after correcting the movement direction of the stage are expressed by $X'=X-(X\times\theta t\times\cos((1-\theta t)/2))$ and $Y'=X\times\sin((1-\theta t)/2)$, respectively, and an ejection timing correction value X(Dn) of the imprint material for a nozzle that is disposed on the n-th order from a reference nozzle position is expressed by $X(Dn)=n(\theta t+\theta d)$.

* * * * *